United States Patent [19]

Shimai

[11] 4,428,264

[45] Jan. 31, 1984

[54] APPARATUS FOR FORMING AN ELEMENT-FREE GAP IN A CONTINUOUS SLIDE FASTENER CHAIN

[75] Inventor: Hideo Shimai, Namerikawa, Japan

[73] Assignee: Yoshida Kogyo K. K., Tokyo, Japan

[21] Appl. No.: 346,845

[22] Filed: Feb. 8, 1982

[30] Foreign Application Priority Data

Feb. 12, 1981 [JP] Japan ..... 56-19977

[51] Int. Cl.[3] ..... B26D 1/25; B26D 7/02

[52] U.S. Cl. ..... 83/465; 83/253; 83/387; 83/622; 83/921; 29/408

[58] Field of Search ..... 83/465, 921, 460, 386, 83/387, 253, 622, 620, 621; 29/408, 410

[56] References Cited

U.S. PATENT DOCUMENTS

| | | | |
|---|---|---|---|
| 3,063,323 | 11/1962 | Graf | 83/921 |
| 3,128,543 | 4/1964 | Fasciano | 29/408 |
| 3,456,328 | 7/1969 | Wasko | 29/408 |
| 3,831,474 | 7/1973 | Perlman | 83/253 |
| 3,958,319 | 5/1976 | Takamatsu | 29/410 |
| 4,307,499 | 12/1981 | Isella | 29/408 |

*Primary Examiner*—Donald R. Schran

*Attorney, Agent, or Firm*—Hill, Van Santen, Steadman & Simpson

[57] ABSTRACT

An apparatus for forming an element-free gap in a continuous slide fastener chain. In the apparatus, a reciprocating punch blade has cutting edges along opposite sides and is relieved at opposite ends along the cutting edges so as to form a pair of wing portions disposed one on each side of the punch blade. An elongated slot formed in a die for receiving the cutting edges has at its opposite ends a pair of lateral branches disposed one on each side of the elongated slot in opposite relation to the sides of the punch blade on which the wing portions are disposed. The wing portions and the lateral branches jointly serve to protect a pair of coupling elements disposed adjacent to the opposite ends of the space section from being cut by the punch blade.

10 Claims, 12 Drawing Figures

APPARATUS FOR FORMING AN ELEMENT-FREE GAP IN A CONTINUOUS SLIDE FASTENER CHAIN

BACKGROUND OF THE INVENTION

1. Field of the Invention

The present invention related to a machine for use in the manufacture of slide fasteners, and more particularly to an apparatus for forming a space section devoid of coupling elements in a continuous slide fastener chain.

2. Prior Art

In order to properly finish ends of slide fasteners, it is necessary to form space sections or element-free gaps in a continuous slide fastener chain without injuring a pair of coupling elements located, respectively, next to endmost coupling elements lying at opposite ends of the respective gap to be formed. In a separable slide fastener adapted to open and close from opposite directions by manipulating a pair of sliders, it is further important to leave lateral projections on the pair of coupling elements uncut.

Various apparatus for providing such element-free sections or gaps in a continuous slide fastener chain are known, and they typically comprise a coacting punch and die unit and an indexing means for locating the slide fastener chain in the desired position relative to a cutting punch in the punch and die unit. Since the cutting punch has a rectangular horizontal cross section having cutting edges on its periphery, a pair of coupling elements located, respectively, next to endmost coupling elements lying at opposite ends of a gap to be formed is cut on respective lateral projections. Furthermore, due to cumulative errors in the coupling element pitch or the fastener tapes being locally elongated or shrunk, the fastener chain cannot always be brought to stop at the desired position in which a length of its elements, corresponding to the gap, register precisely with the cutting punch, in spite of the provision of the indexing means. If the fastener chain were processed for gap formation under such element conditions, the result would be that the terminal elements at either or both ends of the gap and either or both of the elements adjacent to such terminal elements are cut only partly away, with uncut debris interfering with a subsequent finishing operation.

SUMMARY OF THE INVENTION

According to the present invention, a reciprocating punch blade movable toward and away from a stationary die has cutting edges along opposite sides projectable into an elongated vertical slot formed centrally in the die for cutting a pair of interengaged coupling elements along a length corresponding to the length of a space section to be formed in a continuous slide fastener chain. The punch blade is relieved at opposite ends along the cutting edges so as to form a pair of wing portions disposed one on each side of the punch blade. The elongated slot has at its opposite ends a pair of lateral branches disposed one on each side of the elongated slot in opposite relation to the sides of the punch blade on which the wing portions are disposed, respectively. The wing portions and the lateral blanches cooperate in protecting a pair of coupling elements disposed, respectively, adjacent to terminal coupling elements lying at opposite ends of the space section, from being cut by the punch blade.

An object of the present invention is to provide an apparatus in which an element free gap or space section can be formed in a continuous slide fastener chain accurately without injuring a pair of the coupling elements located adjacent to the gap to be formed.

Another object of the present invention is to provide an apparatus including a coacting punch and die having improved structure for protecting a pair of coupling elements located adjacent to opposite ends of a gap to be formed from being cut half or partly away.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 2:
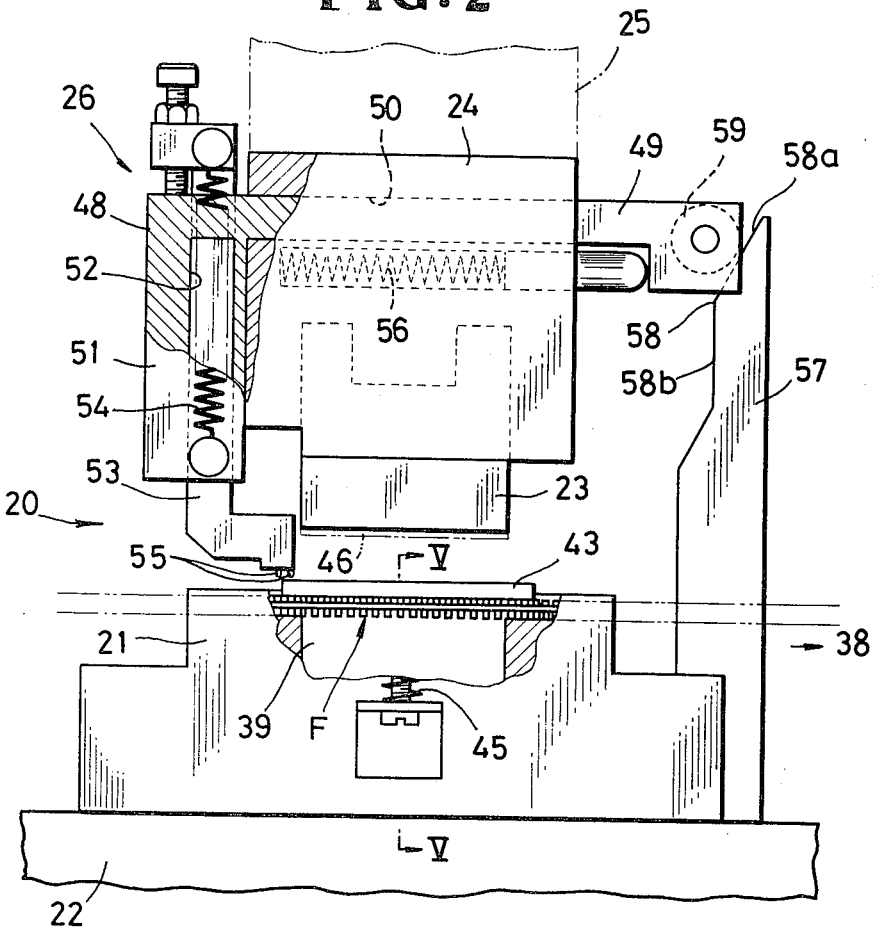
FIG. 2 is a front elevational view, partly in cross section, of an apparatus incorporating the present invention.

The principles of the present invention are particularly useful when embodied in an apparatus such as shown in FIG. 2, generally indicated by the numeral 20.

Figure 1:
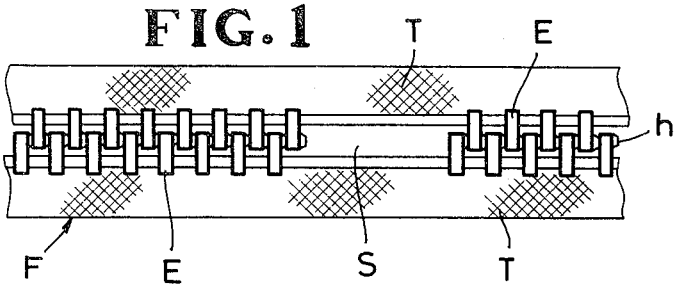
FIG. 1 is a fragmentary plan view of a continuous slide fastener chain having an element-free gap or space section formed by an apparatus of the present invention.

The apparatus 20 generally comprises a stationary die 21 mounted on a frame 22, a punch blade 23 carried by a punch holder 24 adapted to be connected to a plunger 25 for reciprocating the punch blade 23 toward and away from the die 21, and an indexing means 26 responsive to the punch blade 23 for locating a continuous slide fastener chain F in the desired position relative to the punch blade and die 23 and 21. As best shown in FIG. 1, the slide fastener chain F includes a pair of stringer tapes T,T carrying along their adjacent longitudinal edges a pair of rows of interengaged discrete coupling elements E,E each having a coupling head with a lateral projection h.

Figure 3:
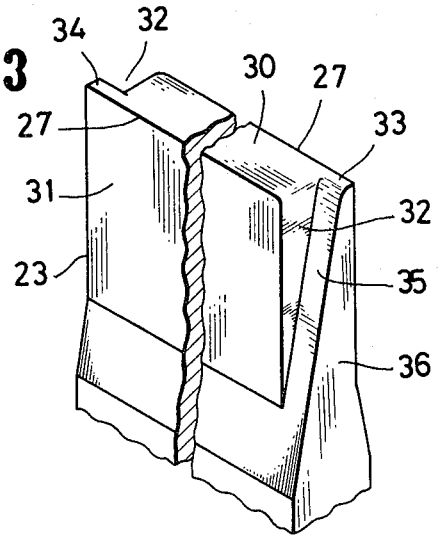
FIG. 3 is an enlarged fragmentary perspective view of a punch blade of the apparatus shown in FIG. 2.

The punch blade 23 is of a substantially rectangular shape as viewed from the horizontal plan and has a pair of cutting edges 27,27 only along opposite sides, as shown in FIG. 3. The cutting edges 27,27 are formed on opposite corners at which a bottom surface 30 joins a pair of sidewalls 31,31 of the punch blade 23. The punch blade 23 is relieved, as at 32, at opposite ends along the cutting edges 27,27 so as to form a pair of narrow wing portions 33,34 disposed one on each side of the punch blade 23. Each wing portion 33,34 has an inclined sidewall 35 which is formed by relieving the punch blade 23, and by which the wing portion 33,34 increases progressively in cross section for purposes described below. In the illustrated embodiment, each wing portion 33,34 has a length substantially equal to half the element pitch, but it may vary to extend in a range from the width of an individual coupling element E to the space between two adjacent coupling elements E,E. Corners formed jointly by the bottom surface 30 and the reliefs 32, 33 of the end walls 36, 36, and formed by the bottom surface 30 and the inclined sidewalls 35,35 of the wing portions 33,34 are rounded.

Figure 4:
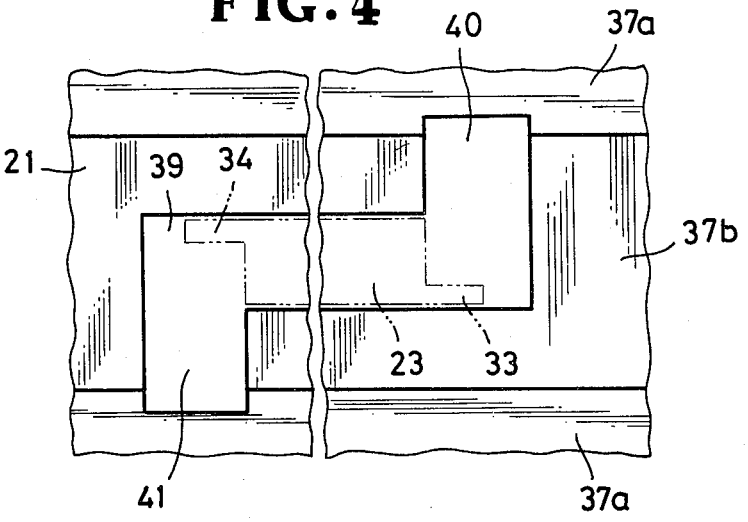
FIG. 4 is an enlarged fragmentary plan view of a die of the apparatus shown in FIG. 2.
Figure 5:
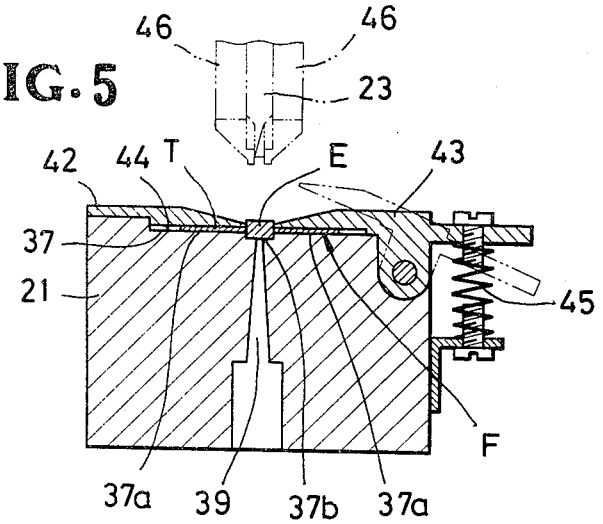
FIG. 5 is a cross-sectional view taken along line V—V of FIG. 2.
Figure 11:
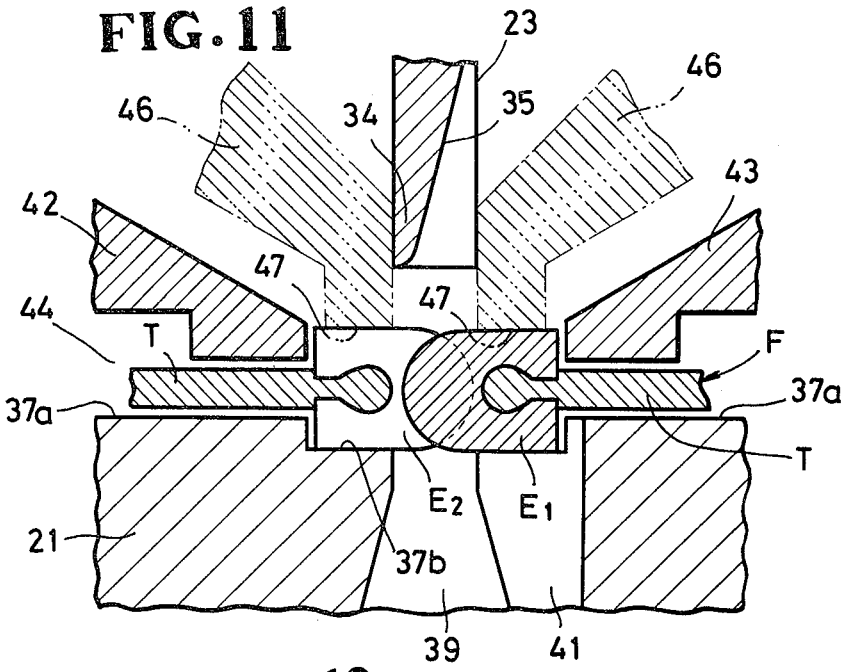
FIGS. 11 and 12 are enlarged cross-sectional views taken along line XI—XI of FIG. 8 and show a mode of a pair of interengaged coupling elements during the gap-forming operation.
Figure 12:
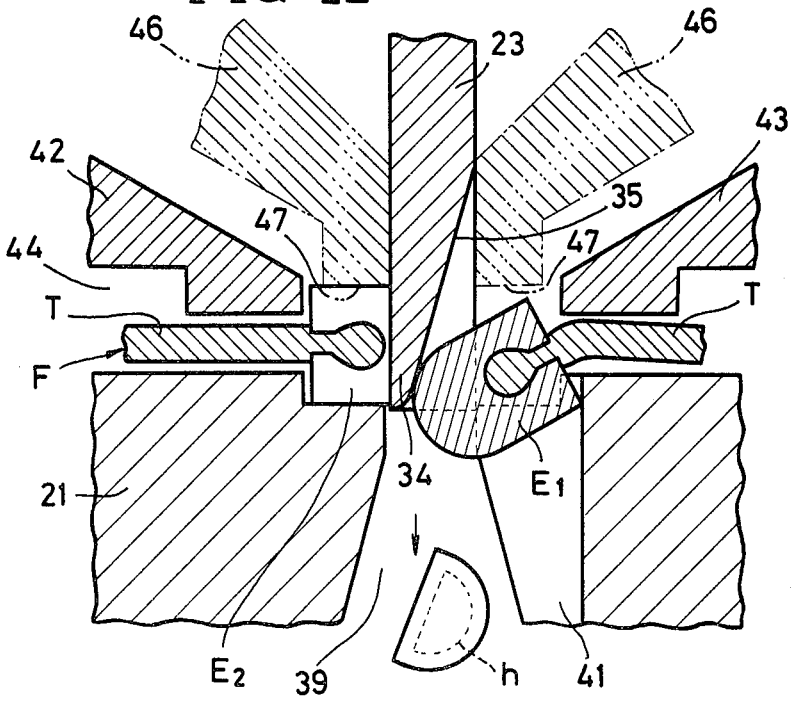

The stationary die 21 has in its top surface a longitudinal guide groove 37 (FIG. 5) along which the slide fastener chain F is transported intermittently in a direction indicated by the arrow 38 in FIG. 2 by means of a suitable chain feeding unit (not shown). As shown in FIGS. 5, 11 and 12, the guide groove 37 is composed of a pair of spaced shallow groove portions 37*a*,37*a* for receiving the tapes T,T, respectively, and a deep groove portion 37*b* extending between the shallow groove portions 37*a*,37*a* for receiving the interengaged coupling element rows E,E. The stationary die 21 further has an elongated vertical slot 39 opening at an upper end to the deep guide groove portion 37*b* substantially centrally of its length and width. Upon actuation of the plunger 25, the cutting edges 37,37 of the punch blade 23 projects into the elongated slot 39 for cutting interengaged coupling elements E,E along a length corresponding to the length of a space section S (FIG. 1) to be formed in the slide fastener chain F. As shown in FIG. 4, the elongated slot 39 preferably, has a length longer than the length of the punch blade 23 by a distance substantially equal to half the element pitch, and it includes a pair of lateral branches 40,41 disposed one on each side of the slot 39, said side being opposite to the side of the cooperating punch blade 23 on which each wing portion 33,34 is disposed. The lateral branches 40,41 extend in opposite directions transversely across the deep guide groove portion 37*b* into the respective shallow guide groove portions 37*a*,37*a* so that one or two coupling elements E struck by either or both of the wing portions 33,34 of the punch blade 23 are permitted to tilt or hinge downwardly into the lateral branches 40,41 during the element-cutting operation, as shown in FIG. 12. The inclined sidewall 35 of each wing portion 33,34 serves to promote the tilting movement of the coupling element E smoothly and to increase the mechanical strength of the wing portion 33,34 per se.

As best shown in FIG. 5, a pair of guide plates 42,43 is supported on the stationary die 21 one on each side of the guide groove 37, and they extend over the shallow groove portions 37*a*,37*a* toward each other to define with the latter a guide channel 44 (FIGS. 5, 11 and 12) for the slide fastener chain F. One of the guide plates 42 is fixed to the die 21, and another guide plate 43 is pivoted to the die 21 for angular movement toward and away from the corresponding shallow guide groove portion 37*a*, the guide plate 43 being normally urged by a compression spring 45 (FIGS. 2 and 5) to the horizontal position shown in solid lines in FIG. 5.

As shown in phantom lines in FIGS. 2, 5, 11 and 12, a pair of pressure pads 46,46 is vertically movably disposed one on each side of the punch blade 23 and extends along the length of the punch blade 23. The pressure pads 46,46 have respective bottom surfaces 47,47 (FIGS. 11 and 12) for clamping the interengaged coupling element rows E,E against the deep guide groove portion 37*b* of the die 21, as shown in FIGS. 11 and 12.

As shown in FIG. 2, the indexing means 26 is disposed at one end of the punch blade 23 and comprises a tilted L-shaped actuating lever 48 supported by the punch holder 24 for vertical motion therewith. The lever 48 has a horizontal arm 49 extending through a horizontal groove 50 in the punch holder 24 and slidable therein along the longitudinal path of the slide fastener chain F. A vertical arm 51 of the lever 48 has a vertical channel 52 extending longitudinally therethrough receiving therein a slide bar 53. The slide bar 53 is continuously urged toward its fully retracted position shown in FIG. 2 by means of a tension spring 54 attached at its lower end to the vertical arm 51, and at its upper end, to the upper end of the slide bar 53. The slide bar 53 is provided at the lower end with a pair of locating pins 55,55 adapted to project into the space between two adjacent individual coupling elements located somewhat rearwardly or upstream, as viewed from the feed direction of the slide fastener chain F, of the rearmost coupling element to be removed from one of the coupling element rows. The actuating lever 48 is normally urged toward the right as viewed in FIG. 2 by means of a compression spring 56 acting between the punch holder 24 and the distal end of the horizontal arm 49. An upright post 57 is mounted on the die 21 in opposite relation to the vertical arm 51 of the actuator lever 48, namely at the opposite side of the punch holder 24. The post 57 has a cam surface 58 facing the punch holder 24 and adapted to engage with a cam follower in the form of a roller 59 rotatably mounted on the distal end of the horizontal arm 49. The cam surface 58 has an upper inclined portion 58*a* and a lower vertical portion 58*b* contiguous to the inclined portion 58*a*. The inclined surface portion 58*a* and the follower roller 59 are adapted to coact for moving the actuating lever 51 and hence the locating pins 55,55 to the left or in a direction opposite to the feed direction 38 of the slide fastener chain F, against the force of the compression spring 56. Rolling engagement of the follower roller 59 with the vertical surface portion 58*b* keeps the locating pins 55,55 at their respective fixed final positions shown in FIG. 8.

The indexing means 26 is arranged to act upon the slide fastener chain F prior to arrival of the cutting edges 27,27 of the punch blade 23 at the top surface of the coupling elements E, as described below with reference to FIGS. 2 and 6–8.

Figure 6:
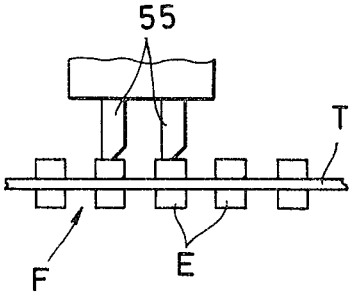
FIGS. 6 and 7 are enlarged diagrammatic views showing the manner in which the slide fastener chain is located in the desired punching position.

When the plunger 25 is operated to move the punch blade 23 downwardly toward the die 21 from the position shown in FIG. 2, the actuating lever 48 and the slide bar 53 start moving, together with the punch holder 24, downwardly toward the slide fastener chain F in the guide groove 37. As the punch holder 24 descends, the tips of the respective locating pins 55,55 strike against and then harmlessly engaged the upper surfaces of the coupling elements E,E, as shown in FIG. 6. During that time, the actuating lever 48 is continuously lowered against the force of the tension spring 54.

Further descending movement of the punch holder 24 brings the follower roller 59 into rolling engagement with the inclined portion 58*a* of the cam surface 58 on the upright post 57. As the follower roller 59 rolls on the inclined portion 58*a* down toward the vertical portion 58*b*, the actuating lever 48 moves to the left or in the direction opposite to the tape-feeding direction 38

Figure 7:
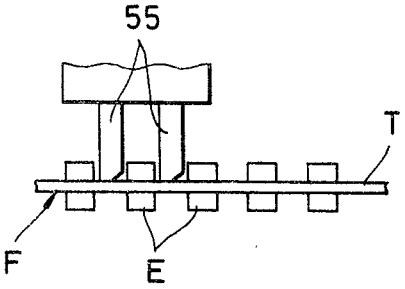
Figure 8:
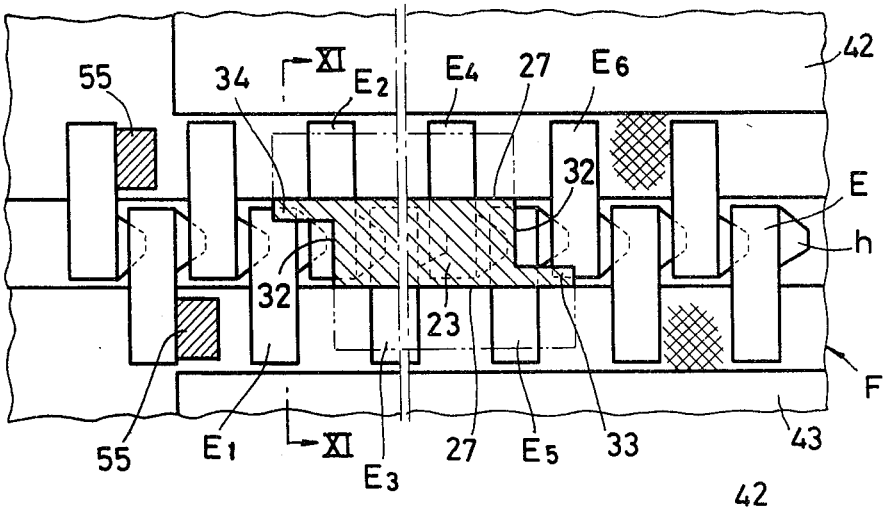
FIGS. 8 to 10 inclusive are enlarged fragmentary plan views of the slide fastener chain shown in different positions relative to the punch blade, respectively.

(FIG. 2) so that each locating pin 55 drops or projects into the next space between two adjacent individual coupling elements E,E as shown in FIG. 7, and then the locating pins 55,55 bring the slide fastener chain F into the desired position with respect to the punch blade and die 23 and 21, the desired position being determined by the cam surface 58B and indicated in FIG. 8. Thereafter, the cutting edges 27,27 of the punch blade 23 act on the upper surface of the coupling elements for cutting the interengaged coupling elements along a length corresponding to the length of the space-section to be formed. During the element-cutting operation, the follower roller 59 continues to roll on the vertical portion **58*b* of the cam surface 58, with the result that the locating pins 55,55 and the slide fastener chain F are kept at their respective final desired position shown in FIG. 8**.

If each locating pin 55 is lowered directly or in the first instance into the space between the two adjacent elements E,E, as shown in FIG. 7, the coacting inclined cam surface and follower roller **58*a* and 59 enable the locating pins 55,55 to shift the slide fastener chain F to the desired position of FIG. 8**.

After the slide fastener chain F has advanced a predetermined length along the guide groove 37 and has come to a stop with the aid of the locating pins 55,55 at the position indicated in FIG. 8, a group of the interengaged coupling elements (four in the illustrated embodiment) $E_2$,$E_3$, $E_4$ and $E_5$, namely that length which is to be cut, is cut by the cutting edges 27,27 of the punch blade 23. A pair of coupling elements $E_1$,$E_6$ located next to the endmost coupling elements $E_2$,$E_5$, respectively is in registry with the wing portions 33,34 and the reliefs 32,32 of the punch blade 23 but is out of registry with the cutting edges 27,27. Accordingly, as the punch blade 23 descends, the sidewalls 35 of the wing portions 34, (33) engage the respective coupling elements $E_1$, ($E_6$) and progressively tilt or hinge them downwardly into the respective lateral branches 41,(40) in the slot 39, as shown in FIGS. 11 and 12. When the punch blade 23 moves upwardly away from the die 21, each element $E_1$, ($E_6$) will return to its horizontal position such as shown in FIG. 11.

Figure 9:
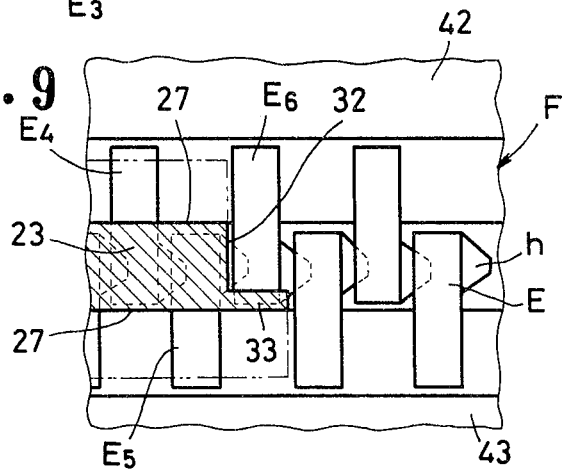
Figure 10:
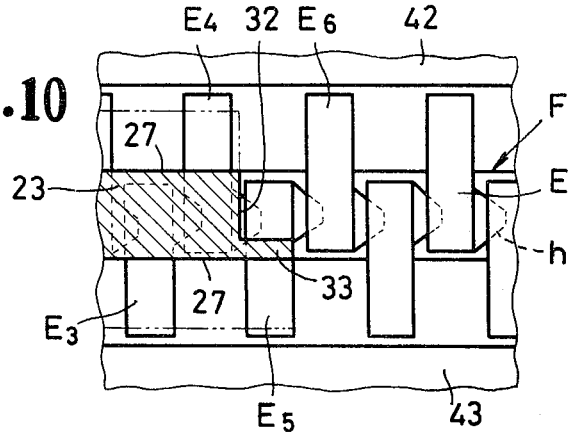

Due to cumulative errors in the coupling element pitch or the stringer tapes being locally elongated or shrunk, the slide fastener chain F can not always be brought to a stop at the desired position shown in FIG. 8. FIGS. 9 and 10 illustrate such element conditions just described above.

In FIG. 9, a pair of rows of interengaged discrete coupling elements E,E of a slide fastener chain F is shrunk and has an element pitch smaller than that shown in FIG. 8. A coupling element $E_6$ located next to an endmost coupling element $E_5$ to be cut is aligned with the wing portion 33 of the punch blade 23. Although the wing portion 33 extends transversely across the coupling element $E_6$, the relief 32 in the punch blade 23 protects the coupling element $E_6$ from being cut by the cutting edges 27,27.

FIG. 10 shows a slide fastener chain F including a pair of rows of interengaged coupling elements E,E which is elongated and has an element pitch greater than that shown in FIG. 8. The wing portion 33 of the punch blade 23 extends across an endmost coupling element $E_5$ to be cut but it comes short of a coupling element $E_6$ adjacent to the coupling element $E_5$. Under the illustrated condition, a space section can be formed by the punch blade 23 without affecting the coupling element $E_6$.

In this manner, the punch blade 23 ensures that the coupling elements $E_1$,$E_6$ located, respectively, adjacent to the terminal coupling elements $E_2$,$E_5$ lying at opposite ends of the gap S to be formed are prevented from being half or partly cut, regardless of the above-described element conditions. Accordingly, it is possible to form a space section S devoid of coupling elements E accurately without interference with a subsequent finishing operation, with the result that an increased rate of production can be achieved. Each of the coupling elements $E_1$,$E_6$ has a coupling head with a lateral projection h so that a slider can pass through the coupling elements $E_1$,$E_6$ smoothly from any of opposite directions to open and close an individual slide fastener which has been separated from the slide fastener chain F.

Although various minor modifications may be suggested by those versed in the art, it should be understood that I wish to embody within the scope of the patent warranted herein, all such embodiments as reasonably and properly come with the scope of my contribution to the art.

What is claimed is:

1. An apparatus for forming a space section devoid of coupling elements in a continuous slide fastener chain having a pair of rows of interengaged coupling elements, the apparatus comprising:

(a) a stationary die having an elongated vertical slot opening to the top surface of said die for underlying the interengaged coupling elements;

(b) a reciprocable punch blade movable toward and away from said die and having cutting edges along opposite sides, said cutting edges being projectable into said elongated slot for cutting the interengaged coupling element along a length corresponding to the length of the space section to be formed, and (c) means responsive to the position of said punch blade for locating the slide fastener chain in the desired position relative to said punch blade, (d) said punch blade being relieved at opposite ends along said cutting edges so as to form a pair of wing portions disposed one on each side of said punch blade, said elongated slot in said die having at its opposite ends a pair of lateral branches disposed one on each side of said elongated slot in opposite relation to said sides of said punch blade on which said wing portions are disposed, respectively.

2. An apparatus according to claim 1, each said wing portion having a length substantially equal to half the element pitch.

3. An apparatus according to claim 1, each said wing portion having an inclined sidewall by which said wing portion increases progressively in cross section.

4. An apparatus according to claim 1, said elongated slot being longer than the length of said punch blade by a distance substantially equal to half the element pitch.

5. An apparatus according to claim 1, said die having in its top surface a guide groove for receiving a length of the slide fastener along a longitudinal path, said guide groove comprising a pair of spaced shallow groove portions for receiving the tapes of the slide fastener chain, and a deep groove portion extending between said shallow groove portions for receiving the interengaged coupling elements, said lateral branches extending in opposite directions across said deep groove portion into said shallow groove portions, respectively.

6. An apparatus according to claim 1, said punch blade being supported by a punch holder, said locating means comprising a slide bar having at the lower end a pair of locating pins adapted to project into the spaces between two adjacent pairs of the interengaged coupling elements prior to the action of the cutting blade on the interengaged coupling elements, means on said punch holder for horizontally slidably holding said slide bar and movable vertically with said punch toward and away from said die, and fixed means disposed at a side of said punch holder for feeding said holding means in a first horizontal direction along the length of the slide fastener chain, for thereby bringing the slide fastener chain into the desired position relative to the punch blade.

7. An apparatus according to claim 6, said holding means comprising an L-shaped actuating lever having a horizontal arm and a vertical arm, said horizontal arm being slidably mounted in a horizontal groove in said punch holder, said vertical arm having a vertical channel extending longitudinally therethrough and receiving therein said slide arm, and a spring acting between said vertical arm, and said slide bar.

8. An apparatus according to claim 7, said spring being a tension spring connected at its upper end to the upper end of said slide bar, and at its lower end to said vertical arm.

9. An apparatus according to claim 7, said feeding means comprising an upright post mounted on said die and having a cam surface, a cam follower on the distal end of said horizontal arm, and a spring acting between said punch holder and said horizontal arm for urging said holding means in a second direction opposite to said first direction, said cam surface and said follower being adapted, in response to the movement of said punch holder, to coact to enable said locating pins first to project into said element spaces, second to bring the slide fastener chain into the desired position, and then keep the slide fastener chain at the desired position.

10. An apparatus according to claim 9, said cam surface comprising of an inclined upper surface facing said first direction and a vertical lower surface contiguous to said upper surface.

* * * * *